United States Patent [19]

Oppel et al.

[11] 4,032,870

[45] June 28, 1977

[54] ELECTRIC CIRCUIT BREAKER WITH ELECTROMAGNETIC-ASSIST MEANS FOR OPPOSING MAGNETIC CONTACT-SEPARATING FORCES

[75] Inventors: John A. Oppel, Aldan; Virgel E. Phillips, Springfield, both of Pa.

[73] Assignee: General Electric Company, Philadelphia, Pa.

[22] Filed: Sept. 15, 1975

[21] Appl. No.: 613,656

[52] U.S. Cl. ..... 335/195; 335/147

[51] Int. Cl.[2] ..... H01H 3/42

[58] Field of Search ..... 200/144 B, 147 R, 250; 335/16, 195, 174, 182, 147; 317/11 A, 11 E

[56] References Cited

UNITED STATES PATENTS

| | | | |
|---|---|---|---|
| 2,821,594 | 1/1958 | Latour | 200/147 R |
| 3,225,160 | 12/1965 | Barkan | 200/250 |
| 3,366,900 | 1/1968 | Barkan | 335/16 X |
| 3,555,223 | 1/1971 | Robinson | 200/144 B |
| 3,663,906 | 5/1972 | Barkan et al. | 335/195 |

*Primary Examiner*—Harold Broome
*Attorney, Agent, or Firm*—William Freedman

[57] ABSTRACT

An electric circuit breaker comprises first and second contacts, which engage each other while the circuit breaker is fully closed and both of which are movable. During the initial portion of an opening operation, the two contacts move together and remain engaged. First electromagnetic-assist means develops while the contacts are engaged a magnetic force on the first contact varying directly with current through the contacts which urges the first contact toward the second contact. Second electromagnetic-assist means develops while the contacts are engaged a magnetic force on the second contact varying directly with current through the contacts which urges the second contact toward the first contact. Means is provided to block motion of the first contact with the second contact after initial opening motion of the second contact and to prevent during subsequent opening motion of the second contact the transmission of force from the first electromagnetic-assist means to the second contact.

14 Claims, 5 Drawing Figures

ELECTRIC CIRCUIT BREAKER WITH ELECTROMAGNETIC-ASSIST MEANS FOR OPPOSING MAGNETIC CONTACT-SEPARATING FORCES

This invention relates to an electric circuit breaker and, more particularly, relates to a circuit breaker that includes electromagnetic means for opposing the magnetic contact-separating forces developed when a high current flows through the contacts of the circuit breaker.

In the usual circuit breaker, the conductive path through the contacts of the circuit breaker constricts at the point of contact-engagement and thus contains portions of a generally loop-shaped configuration immediately adjacent the point of contact-engagement. Current flowing through each of these loop-shaped path portions produces magnetic forces tending to enlarge the loop, and these forces are in a direction tending to open, or separate, the contacts of the breaker. These magnetic contact-separating forces (referred to hereinafter as contact-popping forces) vary in magnitude directly with the square of the current flowing through the contacts; and hence during overcurrent and short-circuit current conditions, extremely high magnetic contact-popping forces can be developed. A more detailed explanation of how these magnetic contact-popping forces are developed is contained in U.S. Pat. No. 3,225,160-Barkan, assigned to the assignee of the present invention. Note particularly FIG. 3 thereof.

One way of holding the contacts closed against these magnetic contact-popping forces is to provide a heavy wipe spring that biases the contact together with a force greater than the maximum contact-popping forces. A disadvantage of this approach is that a large closing mechanism and operator must usually be relied upon for closing the circuit breaker against such a heavy wipe spring. such a mechanism and operator are expensive and are subject to the additional disadvantage that they subject the contacts to heavy impacts when closing the circuit breaker under light current and nocurrent conditions, when the high magnetic contact-popping are not present.

SUMMARY

A general object of our invention is to provide a circuit breaker which is able to hold its contacts in engagement against high contact-popping forces and which can be closed against short-circuit currents by a small and relatively weak closing mechanism and mechanism-operator.

Another object is to provide magnetic-assist means that is effective to hold the contacts in engagement against high contact-popping forces and yet offers little opposition to a contact-opening operation.

Another object is to provide magnetic-assist means that is readily applicable to a circuit breaker that has contacts of a simple and conventional configuration.

Another object is to provide magnetic-assist means capable of performing as in the immediately-preceding objects and also capable of being applied to a circuit interrupter that includes two engageable contacts, one movable through a full opening and closing stroke and the other mounted for limited wipe travel and biased against the first contact by a wipe spring.

Still another object is to provide magnetic-assist means that functions in such a manner that the wipe spring of the immediately-preceding paragraph can be relatively weak, yet without allowing contact-popping under high currents.

Another object is to provide a magnetically-assisted closing mechanism for a plurality of movable contacts which readily lends itself to use of a rigid coupling at ground potential for coupling the contacts together.

In carrying out the invention in one form, we provide a first contact rod and a first contact fixed thereto and a second contact rod and a second contact fixed thereto. The second contact engages the first contact while the circuit breaker is fully closed and is movable out of engagement with the first contact to open the circuit breaker. The first contact is mounted for movement with the second contact following initial engagement of the contacts during the final portion of closing motion of the second contact and during the initial portion of opening motion of the second contact. A wipe spring is coupled to the first contact and biases it toward said second contact.

Coupled to the first contact through the first contact rod, we provide first electromagnetic-assist means for developing, while the contacts are engaged, a magnetic force on the first contact varying directly in accordance with the current through the contacts and urging the first contact toward the second contact. Coupled to the second contact through the second contact rod, we provide second electromagnetic-assist means for developing, while the contacts are engaged, a magnetic force on the second contact varying directly in accordance with the current through said contacts and urging the second contact toward the first contact. Means is provided for blocking motion of the first contact with the second contact after said initial opening motion of the second contact and for preventing during subsequent opening motion of the second contact the transmission of force from the first electromagnetic-assist means to the second contact.

BRIEF DESCRIPTION OF DRAWINGS

For a better understanding of the invention, reference may be had to the accompanying drawings, wherein.

DETAILED DESCRIPTION OF PREFERRED EMBODIMENT

VACUUM INTERRUPTER 10

Figure 1:
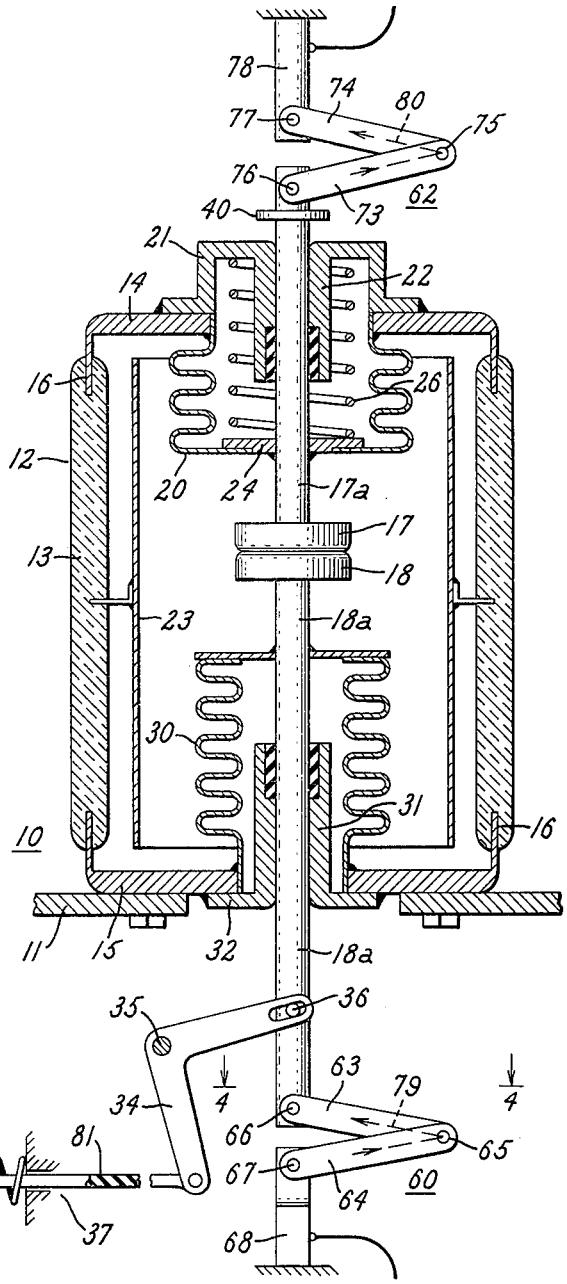
FIG. 1 is a side elevational view, partially in section and partially schematic, illustrating a vacuum-type circuit breaker embodying one form of the invention. The circuit breaker is shown in its fully-closed position.

Referring now to FIG. 1, there is shown a vacuum-type circuit interrupter 10 comprising a highly-evacuated envelope 12 suitably fixed to a stationary support 11. Envelope 12 comprises a tubular housing 13 of insulating material and a pair of metal end caps 14 and 15 joined to opposite ends of the housing by suitable vacuum-tight seals 16. A tubular metal shield 22 of conventional design is provided within housing 13 to protect it from metal vapors generated by arcing during an interrupting operation.

Within envelope 12 and shield 22 there is a pair of separable contacts 17 and 18. Upper contact 17 is mounted for limited vertical movement to provide contact-wipe. Lower contact 18 is the usual movable contact of the interrupter and is mounted for vertical motion through a full opening or closing stroke.

Upper contact 17 is mounted on a vertically-extending contact rod 17*a* that extends freely through the upper end cap 14. A flexible metal bellows 20 is joined at its opposite ends to rod 17*a* and end cap 14 to provide a seal therebetween that permits vertical motion of rod 17*a* with respect to the envelope without impairing the vacuum inside the envelope. For guiding upper contact 17 for straight-line vertical motion, a cup-shaped retainer 21 is fixed to the top of upper end cap 14 and includes a tubular guide member 22 that slidably receives contact rod 17*a*. Fixed to contact rod 17*a* there is a shoulder 24; and between this shoulder and the retainer 21, there is a compression-type wipe spring 26 that biases contact rod 17*a* and contact 17 in a downward direction.

Lower contact 18 is mounted on a vertically-extending movable contact rod 18*a* that extends freely through lower end cap 15. A flexible metal bellows 30 is joined at its opposite ends to contact rod 18*a* and end cap 15 to provide a seal therebetween that permits vertical movement of rod 18*a* with respect to the envelope without impairing the vacuum inside the envelope. For guiding lower contact 18 for straight-line vertical movement, a tubular guide 31 is provided around contact rod 18*a*. Guide 31 includes a mounting flange 32 fixed to end cap 15.

OPENING AND CLOSING OF THE INTERRUPTER 10

When the circuit interrupter is in its fully closed position of FIG. 1, current passes through the interrupter via lower contact rod 18*a*, contacts 18, 17, and upper contact rod 17*a*. Opening of the interrupter is effected by driving contact rod 18*a* downwardly from its position of FIG. 1 by opening force applied through a bellcrank 34. Crank 34 is pivotally mounted on a stationary pivot 35 and has one arm pivotally connected at 36 to the lower end portion of contact rod 18*a*. The other arm of crank 34 is pivotally connected to a suitable operating linkage schematically shown at 37. This linkage 37 can be operated in an opening direction by an opening spring 38 and in a closing direction by suitable closing mechanism and operator 39. When crank 34 is driven in a clockwise direction about its pivot 35 by discharge of the opening spring 38, it drives contact rod 18*a* and contact 18 through a downward opening stroke.

Figure 2:
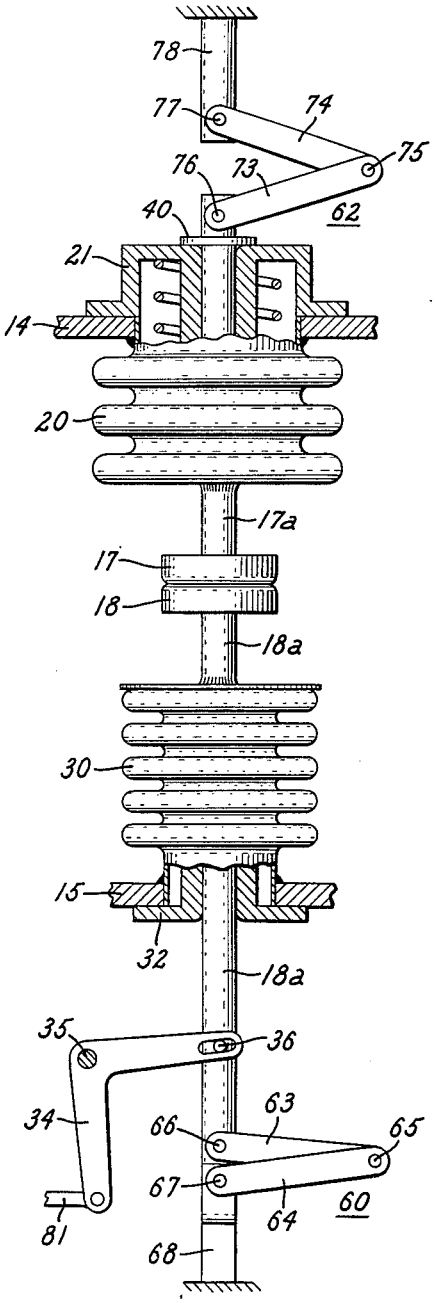
FIG. 2 is a view of the circuit breaker of FIG. 1 at an intermediate point in an opening operation at about the instant of contact-separation.

During the initial portion of the opening stroke, upper contact 17 is driven in downward follow-up relation to lower contact 18 by the wipe spring 26. Engagement between contacts 17 and 18 is maintained until a stop 40 on upper contact rod 17*a* engages the uper surface of stationary retainer 21, as is illustrated in FIG. 2. When such engagement occurs, further downward motion of upper contact 17 is blocked, while contact 18 continues moving downwardly toward its position of FIG. 3, thereby separating the contacts.

Figure 3:
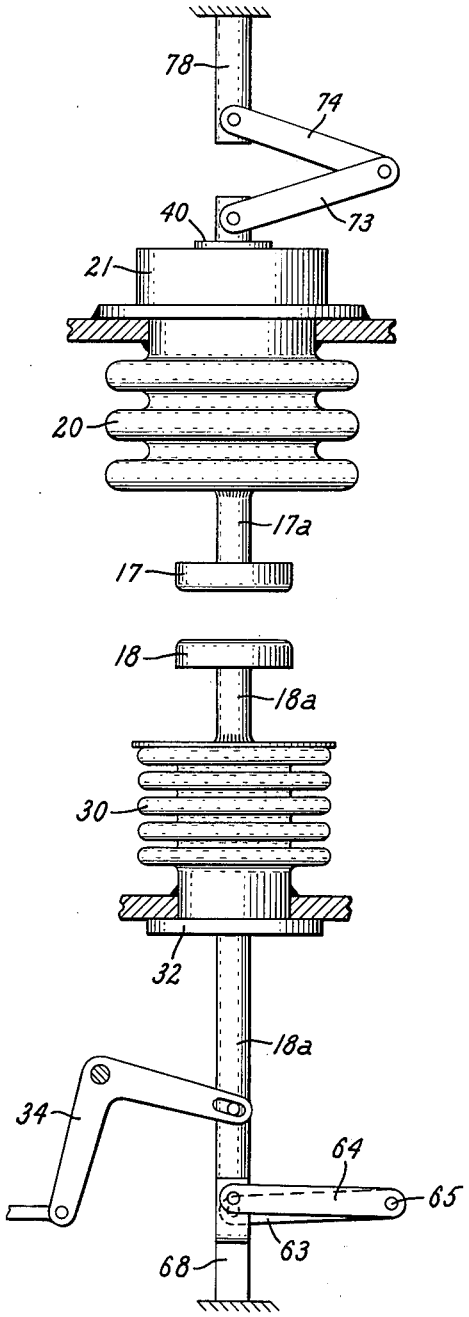
FIG. 3 illustrates the circuit breaker of FIG. 1 is its fully-open position.

Such contact-separation produces an arc between the contacts, which continues until about the instant a natural current zero is reached, at which time it is prevented from reigniting by the high dielectric strength of the vaccum, all in a conventional manner. FIG. 3 shows the interrupter after the contact 18 has been fully separated from contact 17. This position is usually attained before the arc is extinguished.

Closing of the interrupter is effected by driving crank 34 in a counter clockwise direction from its fully-open position of FIG. 3 (with energy supplied from closing mechanism 39 through linkage 37), thereby driving the contact rod 18*a* in an upward closing direction. After a predetermined amount of upward closing travel, contact 18 engages contact 17, as shown in FIG. 2, and the two contacts then move upwardly together from their position of FIG. 2 to their position of FIG. 1. During this travel between the positions of FIG. 2 and FIG. 1, which is referred to herein as contact-wipe travel, the contacts remain in engagement.

ELECTROMAGNETIC-ASSIST DEVICES 60 AND 62

As pointed out hereinabove, when the contacts are in engagement, current flowing through them will develop magnetic forces tending to produce contact-separation, or contact-popping. These forces vary in magnitude directly with the square of the current and thus can be very high when high momentary or short-circuit currents flow. For holding the contacts engaged despite these high contact-popping forces, we provide two separate electromagnetic-assist devices 60 and 62 at opposite ends of the interrupter. One of the magnetic-assist devices 62 is coupled to the upper contact 17 through contact rod 17*a*, and the other magnetic-assist device 60 is coupled to the lower contact 18 through contact rod 18*a*.

The lower electromagnetic-assist device 60 comprises two toggle links 63 and 64 pivotally connected together at one end by a pivot pin 65 forming the knee of a toggle. Link 63 has its opposite end pivotally connected at 66 to movable contact rod 18*a*. Link 64 has its opposite end pivotally connected at 67 to a stationary terminal member 68. In the illustrated form of the invention, terminal member 68 and toggle links 63, 64 are of a highly conductive material, such as copper; and the joints at 65, 66, and 67 (shown schematically as simple pivots) are current-carrying joints capable of carrying large amounts of current therethrough. Member 68 serves as the lower terminal of the interrupter, and the current-carrying toggle is electrically connected in series with the terminal 68 and the contacts of the interrupter in a position between the terminal and conductive contact rods 18*a*.

The upper electromagnetic-assist device 62 is similar to the lower one and also comprises two toggle links 73 and 74 connected together at one end by a pivot pin 75 at the knee of the toggle. Link 73 has its opposite end pivotally connected at 76 to movable contact rod 17*a*. Link 74 has its opposite end pivotally connected at 77 to a stationary terminal member 78. Terminal member 78 serves as the upper terminal of the interrupter, and the current-carrying toggle is electrically connected in series with terminal 78 and the contacts of the interrupter in a position between the terminal and conductive contact rod 17*a*.

When the interrupter is in its position of FIG. 1, current through the lower electromagnetic-assist device 60 follows a loop-shaped path (generally indicated by dotted line arrow 79), flowing at any given instant in one direction through one of the toggle links 64 and in an opposite direction through the adjacent toggle link 63. Current through the upper magnetic-assist device 62 follows a similar loop-shaped path 80. As is well known, the magnetic effect of current through such a loop-shaped path is to force the arms of the loop apart with a magnetic force varying directly with the square of the current through the path. Accordingly, when current flows through electromagnetic-assist device 60, link 63 is urged in an upward direction with a magnetic force varying directly with the square of the current; and when current flows through electromagnetic-assist device 62, link 73 is urged downwardly with a magnetic force varying directly with square of the current. Both of these forces act in a direction to hold the contacts 17, 18 in engagement and to oppose contact-popping forces (i.e., magnetic forces developed at the contacts tending to separate the contacts). When the interrupter is in its position of FIG. 1, the effective magnetic-assist force exceeds the contact-popping force at all values of current and thus prevents contact-popping during high momentary and short-circuit currents.

While the contacts are engaged, the effective magnetic-assist force for opposing contact-popping is equal to the lesser of the two opposing magnetic forces developed by the two magnetic-assist devices 60 and 62. Only the difference between these two magnetic forces is transmitted to the operating crank 34 while the contacts are engaged. Thus, we can make the effective magentic-assist force high enough to prevent contact-popping without transmitting an unduly large force to the operating mechanism. By keeping the magnetic-assist forces developed by the two device 60 and 62 roughly equal while the contacts are engaged, we limit to a low value during this period the difference force that is transmitted to the operating mechanism through crank 34.

The instantaneous force developed at each magnetic-assist device and acting in a vertical direction on the associated contact rod depends also upon the effective distance between the two links of the magnetic-assist device. In the lower electromagnetic-assist device 60 this effective distance is measured by the distance between the axes of pivots 66 and 67. Generally speaking, as 66 approaches 67, the above-described vertical force increases. But when the distance between the axes of 66 and 67 drops below a predetermined value, this vertically-acting force also drops inasmuch as the links 63 and 64 are then almost side-by-side, and the repulsive force between the links begins to act primarily in a horizontal direction. When the distance between the axes of 66 and 67 is zero, the vertically-acting magnetic force is substantially zero. When 66 passes below 67, the vertically-acting magnetic force is in a downward direction on contact rod 18*a*. The effect of these relationships will appear more clearly in the following paragraph.

During the first portion of an opening operation, the above-described magentic-assist forces continue to act to hold the contacts in engagement while the contacts move downwardly together through contact wipe travel. During this wipe travel the forces developed at 60 and 62 approximately balance each other and thus do not significantly interfere with initial opening operation. When stop 40 engages retainer 21 (as shown in FIG. 2) to terminate downward motion of upper contact 17, the magnetic-assist force from the upper magnetic-assist devices 62 that is transmitted to the contacts abruptly drops to zero. The magnetic-assist force from the lower magnetic assist device 60 is still acting in an upward direction on contact 18 and contact rod 18*a* at this instant, but this force will then be at a relatively low value since pivot 66 has then almost reached pivot 67, producing the relationship described in the immediately-preceding paragraph when the links 63 and 64 are almost side-by-side. The opening spring 38 and the inertia of the downwardly moving parts provide ample opening energy to overcome the relatively low remaining upward force that is then being developed by the magnetic-assist device 60 and thus continue the opening operation. After pivot 66 passes below pivot 67, the repulsive force developed at the magnetic-assist device 60 acts vertically downward on contact rod 18*a*, thus assisting the contact-opening operation.

During a closing operation, the closing mechanism 39 is able to drive the lower contact 18 upwardly from its position of FIG. 3 almost into its position of FIG. 2 without being affected by the magnetic-assist devices 60 and 62 since no current is then flowing through these devices. Just prior to engagement of the contacts, a prestrike between the contacts is likely to occur, and this will initiate current flow through the two magnetic-assist devices 60 and 62. This initial current through the lower magnetic-assist device 60 causes magnetic-assist device 60 to act on the contact 18 in an upward direction to aid contact-closing, though with a rather modest force initially since link 63 is then only slightly above link 64 and the current has not yet had time to build up. Until the contacts engage, the upper magnetic-assist device 62 is ineffective to exert a force on moving contact 18. By the time contact-engagement occurs, the lower magentic-assist device 60 has moved into its position of FIG. 2 and is thus in a condition to exert a substantially larger upward magnetic force on the moving contact than initially. This larger upward magnetic force plus the force from the operating mechanism is sufficient to overcome opposing magnetic forces then developed at the upper magnetic-assist device 62, thus driving the contacts 17 and 18 into their fully-closed position of FIG. 1.

The magnetic-assist devices 60 and 62, in addition to preventing contact-popping caused by magnetic contact-repulsion forces, also reduce the tendency of the contacts to bounce apart as a result of the initial impact between the contacts during closing. In this respect, as soon as the contacts engage while closing against substantial currents, the magnetic-assist devices are developing magnetic forces resisting the tendency of the contacts to bounce apart.

Although the only contact-opening magnetic forces mentioned hereinabove are contact-popping forces, it is to be understood that in certain circuit breakers, the larger current path through the circuit breaker will have a configuration such as to cause additional magnetic forces acting in an opening direction to be developed when current flows through the circuit breaker. The magnetic-assist devices 60 and 62 are capable of opposing such forces when in positions near those of FIGS. 1 and 2.

Figure 4:
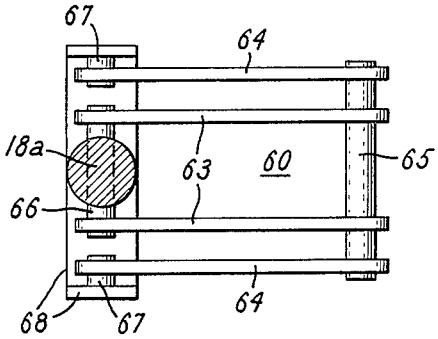
FIG. 4 is a sectional view along the line 4—4 of FIG. 1.
Figure 4:
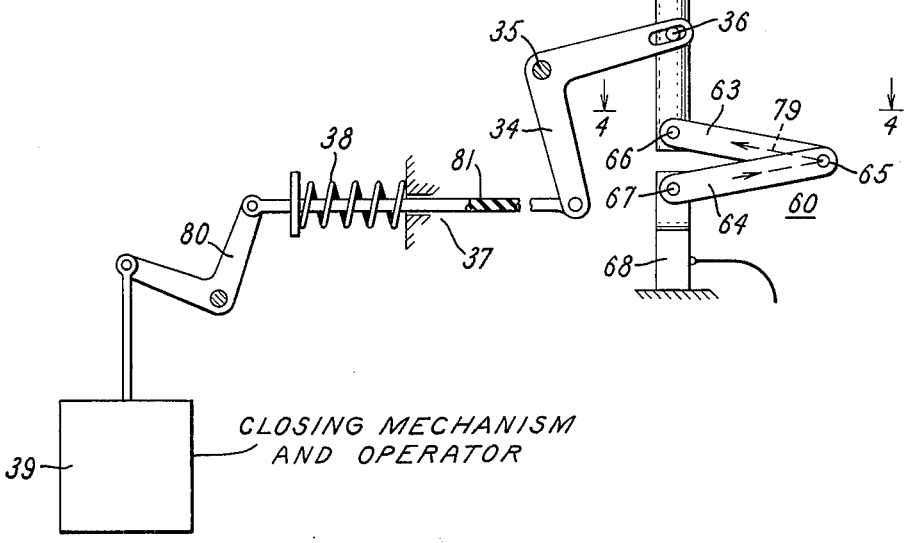

In a preferred embodiment of the invention, the links 63, 64 and 73, 74 of the electromagnetic-assist devices 60 and 62 each comprise two side-by-side elements suitably fixed to each other and located on opposite sides of their associated contact rod. This construction is shown in FIG. 4, which is a sectional view along the line 4—4 of FIG. 1. It will also be apparent from this figure that the lower terminal member 68 is a yoke-like member that is shaped to permit link 63 to move into a position beneath link 64 during an opening operation, as described hereinabove.

Figure 5:
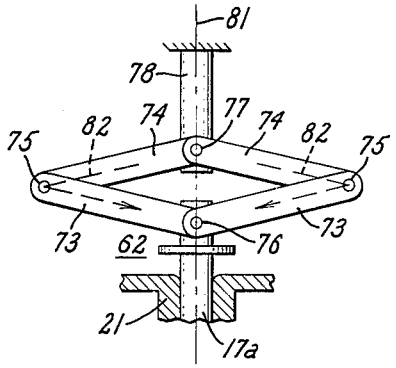
FIG. 5 illustrates a modified form of the invention.

In a modified form of the invention shown in FIG. 5, I utilize two separate linkages (each designated 73–75) for the upper magnetic-assist device 62. These two linkages are electrically connected in parallel with each other and are disposed on opposite sides of a vertical reference plane 81 that includes the central longitudinal axis of contact rod 17*a*, i.e., the axis along which contact 17 is movable. Current flowing through the magnetic-assist device 62 divides substantially equally between the two linkages 73–75 on opposite side of vertical reference plane 81, following a loop-shaped path 82 through each linkage. The main advantage of this modification is that the side thrust forces developed at each linkage 73–75 are balanced by those developed at the other linkage 73–75, thus substantially eliminating any net side thrust on contact rod 17*a* and permitting smoother operation of the rod contact in its slide bearing 22.

Although not specifically illustrated, the lower magnetic-assist device 60 of this latter embodiment is modified in a corresponding manner to that illustrated in FIG. 5, i.e., to include two separate toggle linkages, each corresponding to 63–65 of FIG. 1, on opposite sides of a central vertical reference plane including the longitudinal axis of contact rod 18*a*. Such an arrangement substantially eliminates the net side thrust on movable contact rod 18*a* in the same manner as described in the immediately-preceding paragraph with reference to FIG. 5.

Although I have described the magnetic-assist devices 60 and 62 of FIGS. 1 and 5 as comprising current-carrying links and current-carrying pivotal joints, it is to be understood that other similar constructions coupled to the contact rods can be used for carrying current via the depicted loop-shaped paths. For example, flexible conductive braid can be attached to the links, as shown in U.S. Pat. No. 3,663,906-Barkan et al, for carrying current via a path of the desired configuration.

GENERAL DISCUSSION

While in our circuit breaker the forces due to the wipe spring 26 and the opening spring 38 are still transmitted to the closing mechanism 39, as in conventional designs, these forces are easily accommodated by out mechanism because these springs (26 and 38) are much weaker than corresponding springs in conventional designs of the same momentary or interrupting current rating. This is the case because these springs can be selected without regard to the high magnetic contact-separating forces developed by high currents through the contacts. These high magnetic forces are now borne primarily by the magnetic-assist means 60, 62 and not by the wipe spring 26 or by the operating linkage 37 or closing mechanism 39.

Because we are able to use a weaker wipe spring, we subject the contacts to much lower impacts during closing against light currents or no current than would be the case if the usual much-heavier wipe spring was relied upon. In addition, since the closing force from our mechanism 39 is much lower than in conventional mechanisms, which supply the same high closing force for all currents, there is less closing force supplied by our mechanism during no-current or light-current closing to produce heavy impacts between the contacts. By reducing the severity of such impacts, we can increase the life of the contacts and other components of the interrupter, such as its seals and bellows.

Because our closing mechanism 39 and operating linkage 37 are no longer required to withstand the full magnetic contact-separating forces (which are now borne primarily by the magnetic-assist means 60, 62), they can be much less massive than without the magnetic assist means. This reduced mass not only reduces their cost but also enables them to operate at higher speeds and with shorter response times, thus permitting faster circuit-breaker opening.

An important feature of our invention is that out magnetic assist means is readily applicable to a circuit interrupter having contacts of a simple and conventional design, e.g., the simple butt contacts 17 and 18 of FIG. 1. Each of the magnetic-assist devices 60 and 62 is separate from the contacts and is coupled to its associated contact through the associated contact rod. If the magnetic-assist devices were built into the contacts themselves, they would be exposed to the erosive effects of arcing, contact simplicity would be sacrificed, crucial extra space in the contact region would be consumed, and undesirable compromises in the choice of contct materials might be required. By separating the magnetic-assist devices from the contacts, we are able to avoid these disadvantages.

If an interrupter such as shown in FIG. 1 is provided in each phase of a polyphase circuit, it is a simple matter to mechanically couple together such interrupters for substantially simultaneous operation. This can be done by providing each additional interrupter with a linkage 37 of the same form as shown in FIG. 1 and by rigidly coupling together the cranks 80 within each linkage by means of a coupling such as shown at 92 in U.S. Pat. No. 3,163,745-Miller. Cranks 80 are at ground potential, and this coupling will likewise be at ground potential. The rod 81 that extends between the cranks 80 and 34 of FIG. 1 is of insulating material so as to electrically isolate parts 80 and 34. It will be apparent that the presence of the magnetic-assist means 60, 62 does not interfere with the desired rigid mechanical coupling between such interrupters.

If a plurality of interrupters such as shown in FIG. 1 are connected in series, each can be provided with magnetic-assist means such as 60 and 62 and with a crank such as 34; and the operating rod 81 can be extended and coupled to these cranks. This results in a rigid linkage between the movable contacts of the series-connected interrupters for synchronizing their motion and permitting operation from a single operating mechanism. An example of such a linkage is shown in U.S. Pat. No. 3,418,439-Casey et al.

While we have shown and described particular embodiments of our invention, it will be obvious to those skilled in the art that various changes and modifications may be made without departing from out invention in its broader aspects; and we, therefore, intend herein to cover all such changes and modifications as fall within the true spirit and scope of our invention.

What we claim as new and desire to secure by Letters Patent of the United States is:

1. An electric circuit breaker comprising:

a. a first contact rod and a first contact fixed thereto, b. a second contact rod and a second contact fixed thereto, said second contact being movable into engagement with said first contact to close said circuit breaker and movable out of engagement with said first contact to open the circuit breaker and interrupt the circuit therethrough, said second contact remaining in engagement with said first contact while said circuit breaker is in its fully closed position, c. means for movably mounting said first contact for movement with said second contact: (i) following initial engagement of said contacts during the final portion of closing motion of said contact and (ii) during the initial portion of opening motion of said second contact, d. first electromagnetic-assist means coupled through said first contact rod to said first contact for developing while said contacts are engaged a magnetic force on said first contact which varies directly in accordance with the current through said contacts and which urges said first contact toward said second contact, e. second electromagnetic-assist means coupled through said second contact rod to said second contact for developing while said contacts are engaged a magnetic force on said second contact which varies directly in accordance with the current through said contacts and which urges said second contact toward said first contact, f. and means for blocking motion of said first contact with said second contact after said initial opening motion of said second contact and for preventing during subsequent opening motion of said second contact the transmission of force from said first electromagnetic-assist means to said second contact.

2. The circuit breaker of claim 1 in which said second electromagnetic-assist means is so constructed that immediately prior to the point of contact-separation during an opening operation, said second electromagnetic-assist means develops a reduced magnetic force on said second contact for a given current through said contacts in comparison with the force developed by said second electromagnetic assist means when the contacts are in their fully-closed position.

3. The circuit breaker of claim 1 in which said second electromagnetic-assist means is so constructed that at a predetermined point in an opening operation following contact-separation, said second electromagnetic-assist means develops a magnetic force on said second contact urging said second contact away from said first contact and varying directly in accordance with the current through said contacts.

4. The circuit breaker of claim 2 in which said second electromagnetic-assist means is so constructed that at a predetermined point in an opening operation following contact-separation, said second electromagnetic-assist means develops a magnetic force on said second contact urging said second contact away from said first contact and varying directly in accordance with the current through said contacts.

5. The circuits breaker of claim 1 in which:

a. said first electromagnetic-assist means comprises means defining a first loop-shaped current path in series with said contacts, b. said first loop-shaped path comprises a pair of series-connected first arms between which a repulsive magnetic force is developed that urges said first arms apart when current traverses said first loop-shaped path, and c. one of said first arms is mechanically coupled to said first contact, whereby said magnetic force on said first contact is derived from said repulsive force.

6. The circuit breaker of claim 1 in which:

a. said second electromagnetic-assist means comprises means defining a second loop-shaped current path in series with said contacts, b. said second loop-shaped path comprises a pair of series-connected second arms between which a repulsive magnetic force is developed that urges said second arms apart when current traverses said second loop-shaped path, and c. one of said second arms is mechanically coupled to said second contact to transmit said repulsive force to said second contact, whereby said magnetic force on said second contact is derived from said repulsive force between said second arms.

7. The circuit breaker of claim 5 in which:

a. said second electromagnetic-assist means comprises means defining a second loop-shaped current path in series with said contacts, b. said second loop-shaped path comprises a pair of series-connected second arms between which a repulsive magnetic force is developed that urges said second arms apart when current traverses said second loop-shaped path, and c. one of said second arms is mechanically coupled to said second contact to transmit said repulsive force to said second contact, whereby said magnetic force on said second contact is derived from said repulsive force between said second arms.

8. A vacuum type circuit breaker constructed as defined in claim 1 and further comprising a highly evacuated envelope in which said contacts are located.

9. The circuit breaker of claim 8 in which said two electromagnetic-assist means are located outside said evacuated envelope.

10. The circuit breaker of claim 1 in combination with wipe spring means coupled to said first contact and biasing said first contact toward said second contact.

11. The circuit breaker of claim 2 in combination with wipe spring means coupled to said first contact and biasing said first contact toward said second contact.

12. The circuit breaker of claim 9 in combination with wipe spring means coupled to said first contact and biasing said first contact toward said second contact.

13. The circuit breaker of claim 1 in which:

a. said first electromagnetic-assist means comprises means defining two parallel-connected, loop-shaped current paths in series with said contacts, b. each of said loop-shaped paths comprises a pair of series-connected arms between which a repulsive magnetic force is developed that urges said arms apart when current traverses said loop-shaped path, c. one of said arms of each loop-shaped path is mechanically coupled to said first contact, whereby said magnetic force on said first contact is derived from said repulsive force, d. said two loop-shaped paths are located on opposite sides of a reference plane including the axis along which said first contact rod is movable, thereby reducing any side thrust on said first contact rod developed by said first magnetic-assist means.

14. The circuit breaker of claim 1 in which:

a. said second electromagnetic-assist means comprises means defining two parallel-connected, loop-shaped current paths in series with said contacts, b. each of said loop-shaped paths comprises a pair of series-connected arms between which a repulsive magnetic force is developed that urges said arms apart when current traverses said loop-shaped path, c. one of said arms of each loop-shaped path is mechanically coupled to said second contact rod, whereby said magentic force on said second contact is derived from said repulsive force, d. said two loop-shaped paths are located on opposite sides of a reference plane including the axis along which said second contact rod is movable, thereby reducing any side thrust on said second contact rod developed by said second magnetic-assist means.

* * * * *